US012544652B2

(12) United States Patent
Weig

(10) Patent No.: US 12,544,652 B2
(45) **Date of Patent: *Feb. 10, 2026**

(54) SYSTEM FOR STORAGE OF PUZZLE PIECES, SALES UNIT OF A PUZZLE AND A METHOD FOR MANUFACTURING A PUZZLE

(71) Applicant: puzzleYou GmbH, Altenstadt a.d. Waldnaab (DE)

(72) Inventor: Norbert Weig, Parkstein (DE)

(73) Assignee: puzzleYOU GmbH, Altenstadt a.d. Waldnaab (DE)

( * ) Notice: Subject to any disclaimer, the term of this patent is extended or adjusted under 35 U.S.C. 154(b) by 0 days.

This patent is subject to a terminal disclaimer.

(21) Appl. No.: 17/326,827

(22) Filed: May 21, 2021

(65) Prior Publication Data

US 2022/0370891 A1 Nov. 24, 2022

(51) Int. Cl.
*A63F 9/10* (2006.01)

(52) U.S. Cl.
CPC .... *A63F 9/1044* (2013.01); *A63F 2009/1072* (2013.01)

(58) Field of Classification Search
CPC ..... A63F 9/1044; A63F 2009/1072; A63F 2009/105; A63F 2009/1055
See application file for complete search history.

(56) References Cited

U.S. PATENT DOCUMENTS 723,425 A * 3/1903 Thompson ..... A63F 9/1044 273/157 R
1,957,078 A 5/1934 Robillard
1,987,496 A * 1/1935 Springborn ..... A63F 9/1044 273/157 R
2,089,225 A 8/1937 Polachek
(Continued)

FOREIGN PATENT DOCUMENTS

CN 201361741 12/2009
CN 111939554 A 11/2020
(Continued)

OTHER PUBLICATIONS 2020 500 Pc. Jigsaw Puzzle, EBay, 2020, {retrieved on Apr. 3, 2024]. Retrieved from the Internet: <URL: https://www.ebay.com/p/27045715135?iid-175861418857>. (Year: 2020).*
(Continued)

*Primary Examiner* — Steven B Wong
(74) *Attorney, Agent, or Firm* — FLYNN THIEL, P.C.

(57) ABSTRACT

A sales unit of a puzzle with a puzzle which comprises a plurality of puzzle pieces which together form a picture with one or more motifs, as well as a storage container for the puzzle pieces, wherein the puzzle pieces of one picture are assembled into at least two or more groups with two or more puzzle pieces respectively, irrespective of the motif or motifs, wherein the groups of puzzle pieces are arranged separately from one another in the storage container. A method for manufacturing the puzzle as well as a system for storage of a puzzle with a storage container and two or more
(Continued)

dimensionally stable smaller storage containers can include each smaller storage container receiving a group of puzzle pieces with two or more puzzle pieces.

23 Claims, 7 Drawing Sheets

(56) References Cited

U.S. PATENT DOCUMENTS 2,731,766 A * 1/1956 Rubin ..... A63F 9/12 446/99
3,191,937 A * 6/1965 Kropinski ..... A63F 9/06 446/124
3,851,884 A 12/1974 Myller
3,879,861 A 4/1975 Grantham
4,258,920 A 3/1981 Waldron et al.
4,385,467 A 5/1983 Samuels
4,436,307 A * 3/1984 Caldwell ..... A63F 9/1044 273/157 R
4,487,585 A * 12/1984 Goldwasser ..... A63F 9/10 428/905
4,552,361 A * 11/1985 LaFleur ..... A63F 9/1044 273/DIG. 30
4,709,928 A 12/1987 Willingham
4,811,951 A * 3/1989 Dorsey-Zinn ..... A63F 9/10 434/84
4,822,051 A * 4/1989 Nowak ..... A63F 9/10 273/157 R
4,865,325 A * 9/1989 Stolz ..... A63F 9/1044 273/157 R
4,986,756 A * 1/1991 Yamaguchi ..... A63F 9/06 434/96
4,995,813 A * 2/1991 Francioni ..... B44C 3/12 434/96
5,062,637 A * 11/1991 Bianchi ..... A63F 9/10 273/276
5,123,846 A * 6/1992 Lewis ..... A63F 3/0434 434/150
5,203,571 A 4/1993 Fischer
5,249,802 A * 10/1993 McCarthy ..... A63F 9/1044 273/DIG. 30
5,332,220 A 7/1994 Leavy
5,360,215 A * 11/1994 Ruben ..... A63F 9/10 150/112
5,362,054 A 11/1994 Ashemimry
5,375,707 A 12/1994 Richer
5,443,263 A * 8/1995 Olmsted ..... G09B 1/40 273/157 R
5,624,118 A 4/1997 Gottesman
5,735,442 A 4/1998 Emrich
5,865,928 A 2/1999 Lariviere, Jr. et al.
5,868,389 A 2/1999 Kalivas
5,979,895 A * 11/1999 Dove ..... G09B 1/06 434/238
6,141,851 A 11/2000 Reinbold, Jr.
6,364,116 B1 * 4/2002 Ng ..... A63F 9/1044 273/157 R
6,474,641 B1 * 11/2002 Kellock ..... A63F 9/1044 273/156
6,830,150 B1 * 12/2004 Cyr ..... A45C 11/26 206/459.1
7,631,870 B1 * 12/2009 Bennett ..... A63F 9/10 273/157 R
7,815,190 B1 10/2010 Krisch et al.
8,235,207 B2 * 8/2012 Dietenberger ..... A63F 9/1044 273/148 R
9,168,453 B2 10/2015 Handstein
9,308,438 B2 4/2016 Yoshida
9,403,084 B2 * 8/2016 Klemm ..... A63F 9/0666
2002/0093137 A1 7/2002 Enko
2002/0163126 A1 * 11/2002 Caldwell ..... A63F 9/1044 273/157 R
2004/0050225 A1 3/2004 Steiner
2004/0228989 A1 11/2004 Abramek
2005/0167913 A1 * 8/2005 Mucci ..... A63F 9/10 273/157 R
2005/0200076 A1 * 9/2005 Wu ..... A63F 9/10 273/157 R
2005/0236287 A1 10/2005 Bretones et al.
2007/0152400 A1 * 7/2007 Cooper ..... A63F 9/10 273/157 R
2008/0044511 A1 2/2008 Chang et al.
2013/0234390 A1 * 9/2013 Pabon ..... A63F 13/822 273/296
2014/0014540 A1 1/2014 Weldring
2019/0118074 A1 4/2019 Heringer
2021/0146234 A1 * 5/2021 Wheeler ..... A63F 9/1044
2021/0170267 A1 * 6/2021 Malki ..... A63F 9/1044
2022/0047938 A1 * 2/2022 Miller ..... A63F 9/1044
2022/0395997 A1 12/2022 Weig
2022/0409989 A1 12/2022 Weig

FOREIGN PATENT DOCUMENTS

DE 690380 4/1940
DE 1044579 11/1958
DE 132107 8/1978
DE 8900811.1 U1 5/1989
DE 69206090 T2 4/1996
DE 20205099 U1 9/2002
DE 102010021279 A1 11/2011
DE 10 2016 009 069 A1 2/2017
DE 102017124500 B3 12/2018
EP 0518223 A1 12/1992
EP 0697940 B1 2/1996
EP 2 184 141 A1 5/2010
ES 2 485 313 T3 8/2014
FR 1501915 11/1967
FR 2223956 10/1974
FR 2758529 A1 7/1998
GB 2254565 A 10/1992
JP 7-241888 A 9/1995
JP 2009-28493 2/2009
JP 2009-136621 6/2009
JP 5836426 B2 11/2015
JP 2017-42180 A 3/2017
KR 1992-0000167 Y1 1/1992
KR 10-0563625 3/2006
WO 98/42420 A1 10/1998
WO 99/56845 A1 11/1999

OTHER PUBLICATIONS

German Office Action issued in corresponding German Application No. 10 2021 113 338.6, date of mailing Dec. 29, 2021 (4 pages).
International Search Report issued in corresponding International Application No. PCT/EP2022/063790, date of mailing Oct. 7, 2022 (4 pages).
Written Opinion of the International Searching Authority issued in corresponding International Application No. PCT/EP2022/063790, date of mailing Oct. 7, 2022 (7 pages).
Office Action issued in corresponding Germany Application No. 10 2021 113 338.6, date of mailing Dec. 22, 2023 (4 pages).

* cited by examiner

SYSTEM FOR STORAGE OF PUZZLE PIECES, SALES UNIT OF A PUZZLE AND A METHOD FOR MANUFACTURING A PUZZLE

BACKGROUND OF THE INVENTION

Field of the Invention

The invention relates to the field of puzzles, especially a sales unit of a puzzle, which comprises a plurality of puzzle pieces which together forms a picture, as well as a system for storage of a puzzle with a storage container for storing the puzzle pieces, which is also a part of the sales unit. The present invention also concerns a method for manufacturing puzzles.

Most Recent Background Art

Puzzle games are known products, in which a motif, for example a photo, a drawing or a designed graphic image, is manufactured as a puzzle. The motif is very often selected by the manufacturer of the puzzle game in order to then manufacture a plurality of puzzle games with identical motifs. Meanwhile, it is also possible for the customer to use a personal motif and to upload his order, for example, through an Internet page or an app. A template of the motif is very often enclosed in order to make it easy for the customer to reassemble the puzzle. Very often the template of the motif is on the box containing the puzzle. In many cases, the template of the motif is also enclosed as a separate printout, for example as a poster. According to the most recent background art, the puzzle itself is either kept in a bag or the individual puzzle pieces are kept in a box without using a bag. Also, sometimes the puzzle comprises a plurality of bags each of which contains a part of the motif.

Due to the nature of the manufacturing process, in many cases it happens that, one or more puzzle pieces are missing from a puzzle game. The customer concerned often only notices this either very late or at the end of reassembling the puzzle motif. This situation is very annoying for the customer concerned, because then he cannot reassemble the puzzle completely. Sometimes the customer does have the option of making a complaint against the product. But then he might have to again reassemble the puzzle motif completely. In this situation, many manufacturers offer the option of ordering individual pieces. But even this can lead to an additional expense and time delay for the customer concerned.

A further problem arises for a section of customers. A section of customers is either less skilled in assembling puzzle pieces or are less motivated to perform this activity, which demands a lot of time and patience. For example, if the motif contains large single-colored areas, then assembling these motif pieces is usually more difficult than in case of motif or motif pieces which are designed to be very varied. This can be the case especially when using personal motifs because at the time of selecting the motif, many customers hardly pay any attention to the suitability of the motif as a puzzle. Thus, in practice the problem arises that the motif is too difficult for the respective customer.

DISCLOSURE OF THE INVENTION

Object of the Invention

The object of the present invention is to create a puzzle game where the customer can recognize before the assembly whether all puzzle pieces are available and the customer moreover has the option of himself selecting the difficulty level of the puzzle.

Technical Solution

According to the invention, the first partial problem is solved by using a sales unit for a puzzle or a system for storage of a puzzle so that the puzzle pieces are not mixed up and jumbled in a storage container like a box or a bag. The pieces are rather stored in a suitable ordered manner so that it can be easily identified if the number of puzzle pieces is complete by looking at it. The puzzle pieces, which form a picture when put together, are thus assembled together, depending on or irrespective of one or more motifs of the picture, in at least two or more groups with two or more puzzle pieces in each, wherein the groups of puzzle pieces are arranged separate from each other in a storage container. During the manufacture of the puzzle, when the puzzle pieces are separated after dividing the picture into individual puzzle pieces, the separated puzzle pieces of one picture are assembled together depending on or irrespective of one or more motifs of the picture into two or more groups of puzzle pieces and are separated from each other in groups. In order to avoid mixing up the puzzle pieces in a storage container, but rather storing them in a suitable ordered manner, the sales unit has two or more smaller storage containers arranged inside the storage container, wherein one group of puzzle pieces is received in each of the smaller storage containers.

Each smaller storage container is designed in such a manner that through the design of the smaller storage containers and the puzzle pieces, the completeness of the puzzle pieces of each group of puzzle pieces can be ascertained through the interaction of the puzzle pieces and of the smaller storage containers. Thus, the smaller storage container provides a measure for the number of received puzzle pieces or for the completeness of the group of puzzle pieces received in the smaller storage container, wherein this can be done in the simplest manner by matching one dimension of the smaller storage container to one dimension of the puzzle pieces, e.g., their thickness or the number of puzzle pieces. Alternatively or additionally, the smaller storage container can have a visible marking which can help to ascertain whether the number of the received puzzle pieces is as specified.

According to the invention, the second partial problem is solved in that each group of puzzle pieces can be assembled into a puzzle by itself and that each group preferably produces a connected part of the entire picture or the puzzle motif and all the groups together produce the complete puzzle. Thus, the user can himself decide if he wants to assemble the individual groups into a puzzle or mix together two or more groups and assemble them together into a puzzle. Thus, the user has a lot of flexibility in deciding which parts of a picture he wants to assemble into a puzzle at which difficulty level.

A picture in the present description is any type of representation of any type of carrier, like cardboard, which can be separated into individual puzzle pieces, so that a puzzle with a plurality of puzzle pieces is created which can be in turn assembled into the picture.

The number of puzzle pieces in each group can be identical, so that it can be quickly ascertained whether one or more puzzle pieces are missing in a group.

Each group can contain any number of puzzle pieces and can depend on the number of all the puzzle pieces of the puzzle, so that puzzles with a large number of puzzle pieces can have groups with puzzle pieces, whereas puzzles with lesser number of total puzzle pieces can have groups with a lesser number of puzzle pieces. The number of puzzle pieces in each group can be less than or equal to 250 puzzle pieces, especially less than or equal to 100 puzzle pieces, preferably less than or equal to 50 puzzle pieces or less than or equal to 25 or 10 puzzle pieces.

The puzzle pieces in each group of puzzle pieces can represent a clearly defined partial segment of the complete puzzle, wherein the partial segment can be defined by at least one characteristic of the puzzle pieces of a group, which is selected from a number of characteristics comprising the relation to one or more rows of the puzzle, the relation to a part of one or more rows of the puzzle, the relation to one or more columns of the puzzle, the relation to a part of one or more columns of the puzzle, the relation to a local area of the puzzle, one or more basic colors or color elements of the puzzle pieces, boundary pieces of the puzzle, number of recesses or protrusions of the puzzle pieces and combinations thereof.

The puzzle pieces in a group can be sorted, especially according to one of the previously described characteristics of the puzzle pieces, and/or stacked in the sales unit or arranged in the system for storage of the puzzle. This would make it easy to ascertain the correct number of puzzle pieces. For example, if the stacks contain the same number of puzzle pieces, then their height is identical and it can be very easily identified if a puzzle piece is missing because the concerned stack will be shorter. In the same way, other reference sizes can be considered, for example like the holding capacity of a smaller storage container or the height of the smaller storage container or heights of its surrounding walls or markings on the smaller storage container.

Accordingly, protection is requested for an aspect of the invention, independent and irrespective of other aspects of the invention, according to which aspect a claim is made for a system for storage of a puzzle which comprises a plurality of puzzle pieces, which together produce a picture, wherein the system comprises a storage container for storage of the puzzle pieces and two or more smaller storage containers, wherein each smaller storage container can receive a group of puzzle pieces with two or more puzzle pieces. Additionally, each smaller storage container has a measure using which the completeness of the puzzle pieces of each group of puzzle pieces in the smaller storage container can be ascertained when they are arranged in the smaller storage container.

For this purpose, the smaller storage container can be designed to be dimensionally stable in at least one dimension in such a manner that the dimensionally stable dimension of the smaller storage container represents a measure, by, for example, being able to store an exact number of puzzle pieces in the smaller storage container. Additionally or alternatively, the smaller storage container can have a marking which functions as a measure.

The smaller storage containers can be separate individual containers and/or shelves or sections of a common container for multiple groups.

The smaller storage containers can preferably be designed in such a manner that exactly one stack of puzzle pieces can be received in each smaller storage container, so that the correct number of received puzzle pieces can be ascertained easily.

This can be especially achieved in that one or each smaller storage container is designed in such a manner that it defines a storage space which is exactly dimensioned in one dimension in such a manner that a stack of a certain number of puzzle pieces can be kept in the storage space or the stack closes flush with the upper edge of the storage space. Alternatively or additionally, a corresponding marking on the smaller storage container can be used to check that the smaller storage container has been filled with the correct number of puzzle pieces.

The smaller storage container can be especially designed as a closable tube or tub and preferably have a circular cross-section whose diameter is selected so that the puzzle piece with the largest dimension from among the puzzle pieces to be stored can be stored with some gap so that all the puzzle pieces are received loosely. Moreover however, the diameter can be sufficiently small so that a stack can be stored in dimensionally-stable manner in the smaller storage container, that is, individual puzzle pieces cannot break loose from the stack.

The storage container can be made especially using a two-piece cube-shaped carton preferably with a cover and lower part, wherein the smaller storage containers can be made preferably using a one-piece insert for the storage container with a plurality of pockets for storing groups of puzzle pieces. Alternatively, an insert element can be provided which has slots in which the individual smaller storage containers can be especially inserted flexibly. The insert and/or the insert element can be imprinted, especially with the representation or the motif of the picture, wherein the representation or the motif of the picture can be used to arrange the groups of puzzle pieces or smaller storage containers in the pockets or slots where they are received, that is, the puzzle pieces received in a certain pocket or slot of the insert or insert element produce the corresponding part of the picture that is imprinted there.

The smaller storage containers can be respectively closed individually or together. For this purpose, an intermediate layer element can be provided which can be arranged between the storage container, especially between its cover, and the smaller storage containers in order to securely hold and/or close the smaller storage containers. The intermediate layer element can be flexible, for example, an upholstered cushion made of cardboard, plastic, foam or similar material.

After the puzzle pieces have been separated, the separated groups of puzzle pieces can be stored in the individual smaller storage containers in the manufacturing process, so that the groups of puzzle pieces can be stored separately, wherein the puzzle pieces of each group of separated puzzle pieces in turn represent a clearly defined partial segment of the complete puzzle irrespective of the motif or motifs, wherein especially the partial segment is defined by at least one characteristic of the puzzle pieces of a group, which is selected from a number of characteristics comprising the relation to one or more rows of the puzzle, the relation to a part of one or more rows of the puzzle, the relation to one or more columns of the puzzle, the relation to a part of one or more columns of the puzzle, one or more basic colors or color elements of the puzzle pieces, boundary pieces of the puzzle, number of recesses or protrusions of the puzzle pieces and combinations thereof.

The puzzle pieces of each of the groups with two or more of the puzzle pieces can abut each other within a storage compartment of one of the smaller storage containers.

BRIEF DESCRIPTION OF THE FIGURES

The attached drawings show in purely schematic manner

EXEMPLARY EMBODIMENTS

Further advantages, features and characteristics of the present invention will be evident from the following detailed description of the exemplary embodiments. However, the invention is not limited to these exemplary embodiments.

Figure 1:
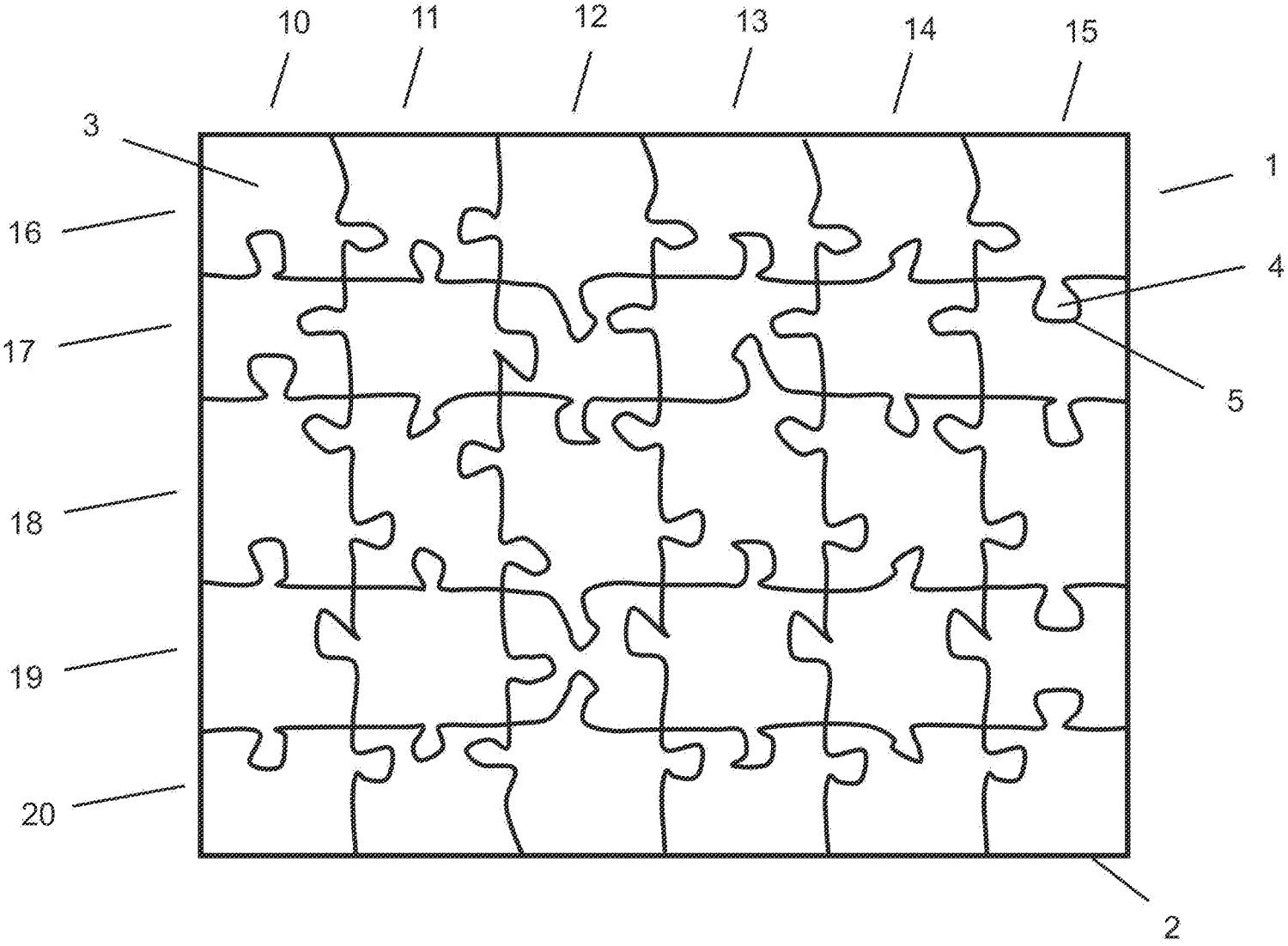
FIG. 1 a representation of a puzzle according to the most recent background art, FIG. 2 a representation of a system for storage of puzzles according to the invention, FIG. 3 a representation of a stack of puzzle pieces which are stored in a smaller storage container according to the invention, FIG. 4 a top view of a separate smaller storage container containing a stack of puzzle pieces, FIG. 5 a perspective view of the smaller storage container from FIG. 4, FIG. 6 a perspective view of another smaller storage container with a cap, FIG. 7 a perspective exploded view of a storage container with an intermediate layer element and an insert element with a plurality of separate smaller storage containers and in FIG. 8 a sectional view through the bottom part of the storage container from FIG. 7 with a smaller storage container wedged into the insert part.

FIG. 1 shows a standard puzzle 1, which represents a picture 2 in the assembled state, which is represented using a carrier, for example, a cardboard carton, and a representation of a motif printed on it. The picture 2, as is standard for puzzle 1, can be separated into a plurality of individual pieces, the so-called puzzle pieces 3, wherein a sales unit of puzzle 1 comprises of the separated puzzle pieces 3 usually in a storage container and the user assembles the puzzles pieces 3 into the picture 2.

The puzzle pieces 3 have these protrusions 4 and recesses 5 for assembling them, which can be designed in various ways, wherein at least one protrusion 4 matches a recess 5, so that the corresponding puzzle pieces 3 can be assembled. The protrusions 4 and recesses 5 of a plurality of puzzle pieces 3 can be designed differently from all or at least a large part of these puzzle pieces, so that a unique arrangement of the puzzle pieces 3 to one another can be produced at least in conjunction with the edges of the puzzle pieces 3 to one another which can similarly vary between the various puzzle pieces.

Often, the puzzle pieces 3 are arranged in 16 to 20 rows and 10 to 15 columns, so that the unique position of each of the puzzle pieces 3 can be defined by specifying the corresponding row 16 to 20 and the column 10 to 15. For example, the puzzle piece 3 located in the upper left corner of puzzle 1 in FIG. 1 can be defined by row 16 and column 10, so that the specification of the row and column, e.g. (16;10), uniquely defines the position of the puzzle piece 3. However, there are also puzzles whose puzzle pieces 3 can be designed and arranged in a completely random manner. Such puzzles are known as so-called random—cut— puzzles.

In case of puzzles constructed in rows and columns as well as random—cut— puzzles, clearly defined partial segments of the puzzle 1 can be specified depending on or irrespective of a motif. According to the present invention, these partial segments can be assembled into groups in the manufacturing process and the groups can be separated. For example, in the exemplary embodiment shown in FIG. 1, the puzzle pieces 3 from the individual rows 16 to 20 or in the individual columns 10 to 15 can be defined into one group respectively. Or groups can be formed from a certain number of puzzle pieces 3, for example, groups of 6 puzzle pieces respectively, like for example the puzzle pieces 3 of the rows 16, 17 and 18 as well as of the columns 10 and 11, the puzzle pieces 3 of the rows 19 and 20 and of the columns 10, 11 and 12, the puzzle pieces 3 of the rows 16, 17 and 18 and of the columns 12 and 13 as well as the puzzle pieces 3 of the rows 16, 17 and 18 as well as of the columns 14 and 15 and the puzzle pieces 3 of the rows 19 and 20 and of the columns 13, 14 and 15. Thus, irrespective of the motif of the picture 2, groups of puzzle pieces 3 can be formed which can be assembled individually from one another and separated if, in the manufacturing process of the puzzle, they have been detached and separated from one another after the picture 2 has been cut into the individual puzzle pieces 3.

Figure 2:
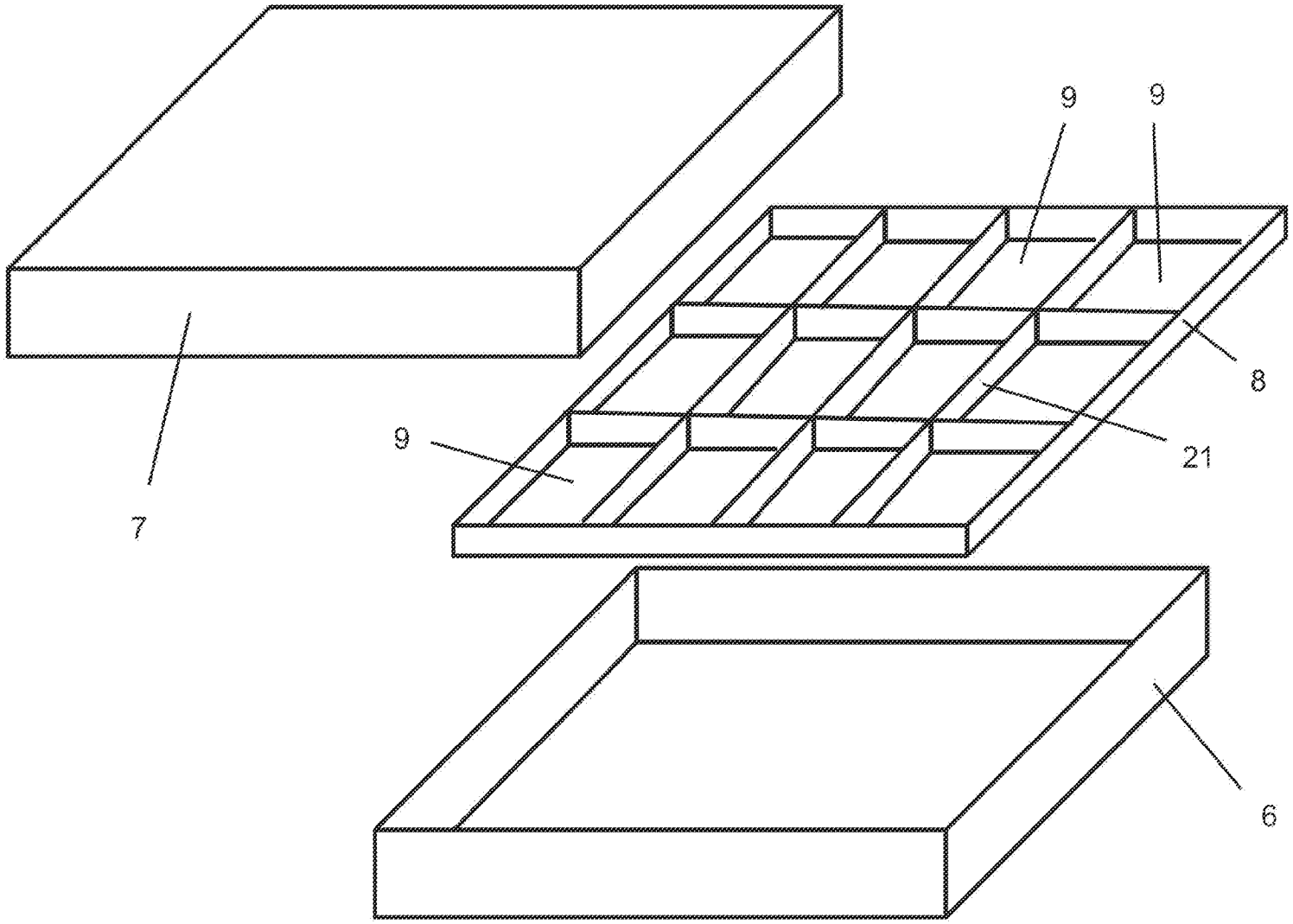

The respective groups of puzzle pieces 3 can be stored in the corresponding smaller storage containers 9, as shown as an example in FIG. 2, so that the corresponding groups of puzzle pieces 3 are received in different smaller storage containers in a sales unit of a puzzle 1 and a user can assemble parts of the puzzle according to the groups of puzzle pieces 3. Naturally, a user can disassemble a completed puzzle 1 again into groups of puzzle pieces 3 depending on how he wants to separate them, wherein the individual groups can be stored in the smaller storage containers 9 separately from one another.

FIG. 2 shows an example for a system for storage of puzzle pieces 3 separated according to groups of puzzle pieces 3, as described above. FIG. 2 shows a storage container with a bottom part 6 and a cover part 7, which together form a cube-shaped carton in which the puzzle pieces 3 can be stored. For separate storage of individual groups of puzzle pieces 3, an insert 8 is provided in the storage container 6, 7 or in the bottom part 6. Similar to the bottom part 6, the insert is formed by an open-top, cube-shaped box or tub, which however has multiple separating walls 21 parallel to the outer sides, so that this form multiple smaller storage containers 9 with an open top in which the individual groups of puzzle pieces 3 can be kept. For example, if the number of puzzle pieces 3 in each group is the same and/or have the same size, which can be easily seen, then this makes it easy to check whether the puzzle pieces 3 of the puzzle 1 received in the storage container 6, 7 or in the smaller storage containers 9 are complete.

Figure 3:
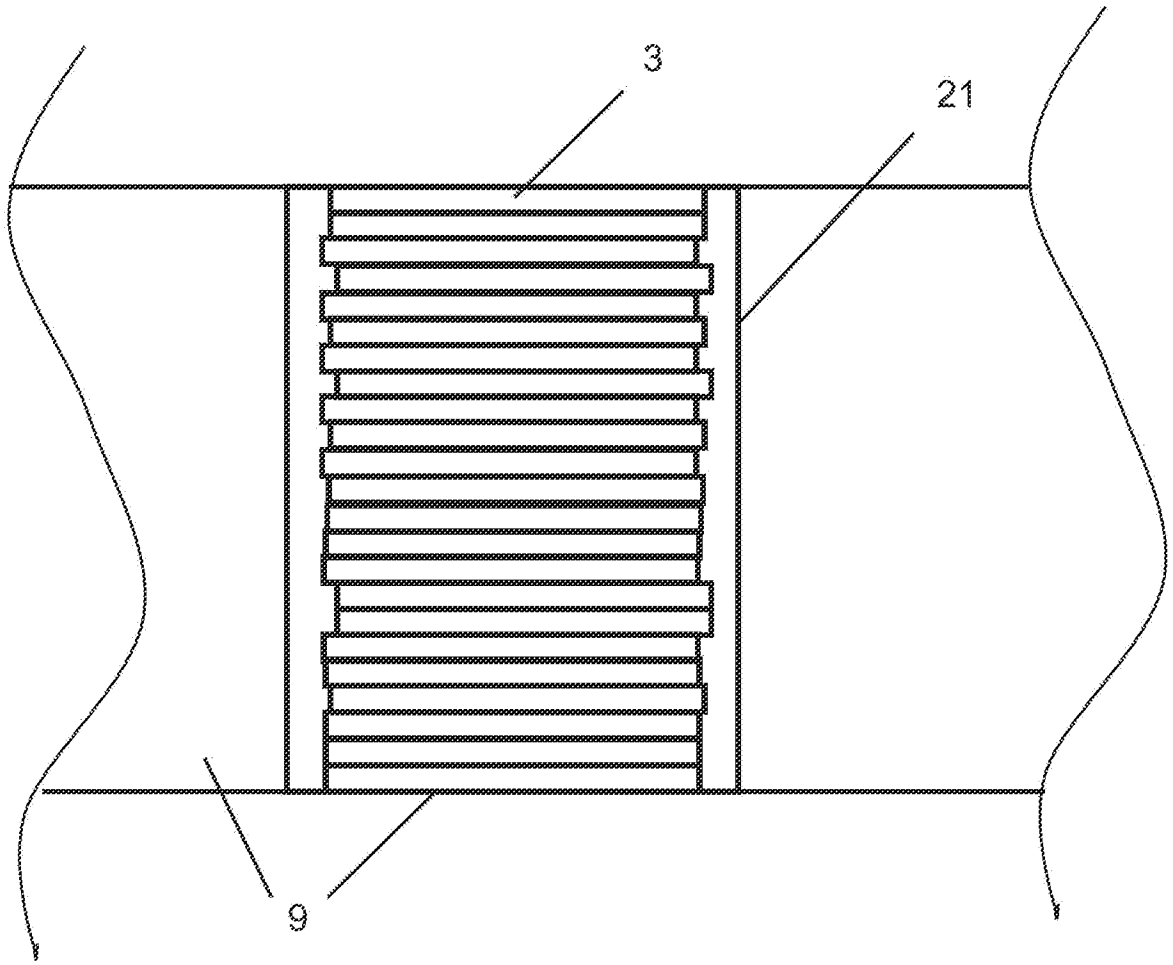

This can be easy especially in case of a larger number of puzzle pieces 3 per group, if the puzzle pieces 3 can be stacked in a smaller storage container 9, so that a single or multiple stacks of puzzle pieces 3 can be received in the smaller storage container 9. This is shown for example in FIG. 3 for a stack of puzzle pieces 3, wherein FIG. 3 shows a detailed view of one of the several smaller storage containers arranged adjacent to one another and several puzzle pieces 3 are stacked in one of the smaller storage containers 9. However, the stack of puzzle pieces in the shown exemplary embodiment are not arranged standing on the lowest puzzle piece but horizontally, so that the stack of puzzle pieces 3 in the storage state is horizontal to the bottom of the smaller storage container 9. As shown in FIG. 3, the stack of puzzle pieces 3 has a height equal to the length of the smaller storage container 9 or a bordering separating wall 21, so that the upper- and lower side of the stack lies flat on the separating walls 21 running parallel to the upper- or lower side of the stack and the stack is wedged in between the separating walls 21. If the smaller storage container 9 contains the correct number of puzzle pieces 3, then the stack is wedged in tightly in the smaller storage container 9, whereas the stack cannot be held in the smaller storage container 9 if puzzle pieces 3 are missing.

Figure 5:
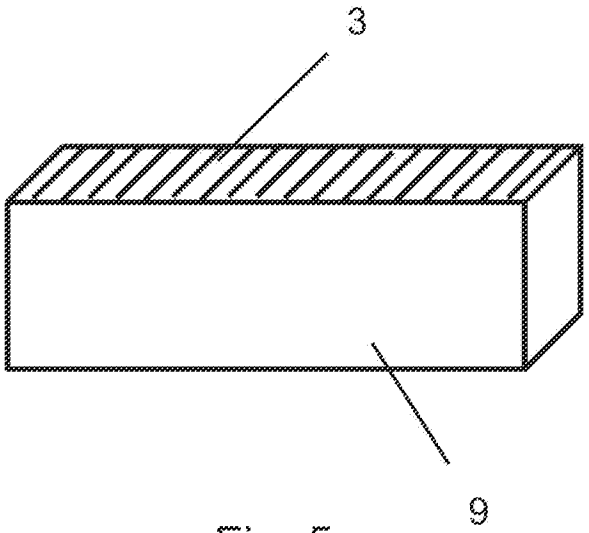
Figure 4:
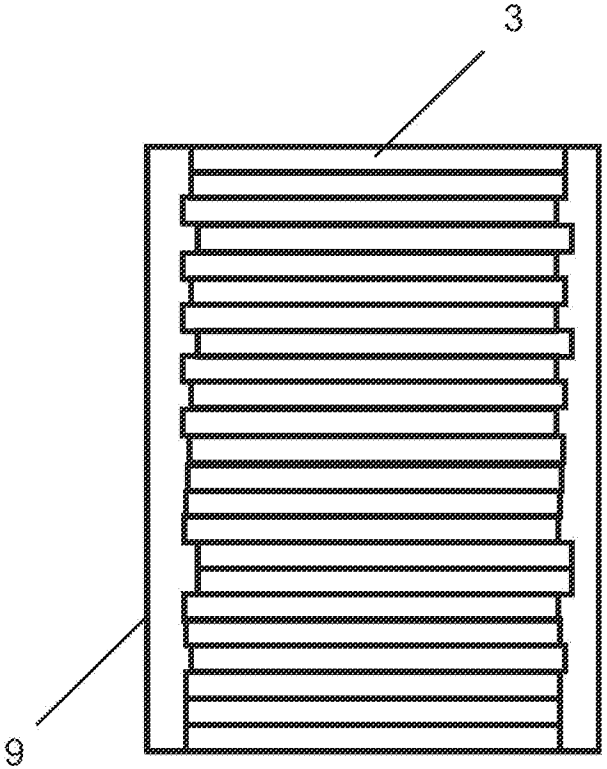

FIG. 3 shows this for one of the multiple smaller storage containers 9 of the insert 8. The FIGS. 4 and 5 show the same storage principle for a smaller storage container 9, which is designed separately. Multiple open-top, cube-shaped smaller storage containers 9, as shown in top view with puzzle pieces 3 wedged therein in FIG. 4 and in perspective view in FIG. 5, can be arranged in a storage container for the puzzle, for example in a cube-shaped box.

Figure 6:
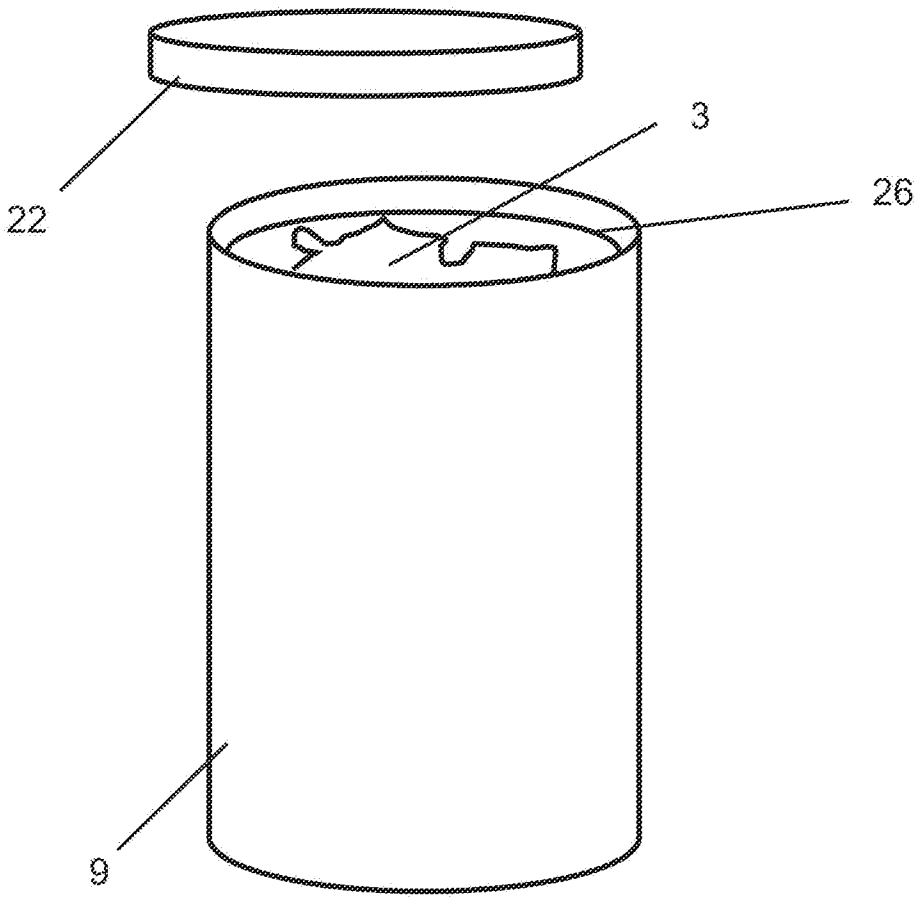

Another embodiment of a smaller storage container 9 is shown in FIG. 6. The smaller storage container 9 of the FIG. 6 is formed by a tub or a one-sided or double-sided closable tube with a circular cross-section, wherein the diameter of the circular cross-section is somewhat larger than the largest dimension of the puzzle pieces 3 to be stored in it, so that a stack of puzzle pieces 3 can be received in the smaller storage container, wherein in this case the puzzle pieces 3 will be received loosely. However, the maximum diameter of the circular cross-section of the tub—or tube-shaped smaller storage container is dimensioned so that individual puzzle pieces 3 of the stack cannot slip out of the stack and, for example, fall in a gap between the stack and the smaller storage container 9.

Moreover, the embodiment of a smaller storage container 9 from the FIG. 6 shows that a corresponding smaller storage container 9 can have a cap 22 in order to prevent the puzzle pieces 3 from falling out.

Furthermore, a marking 26 is provided in FIG. 6 on the upper edge of the smaller storage container 9, using which the correct number of puzzle pieces 3 in the smaller storage container 9 can be easily ascertained. Thus, in this case, the stack of puzzle pieces 3 need not close flush with the upper side of the smaller storage container 9, rather the upper side of the stack must match the marking 26 of the smaller storage container.

However, it is also possible to consider the height of the smaller storage container 9 as a measure for the number and completeness of the puzzle pieces 3 instead of the marking 26. In this case, the puzzle pieces 3 or the upper side of the stack closes flush with the upper boundary of the tub- or tube-shaped smaller storage container 9, if the correct number of puzzle pieces 3 are to be contained in the smaller storage container 9. If the smaller storage container 9 closes its upper side of the edge flush with the puzzle pieces 3, then it contains the correct number of puzzle pieces 3, while this is not the case if a puzzle piece 3 is missing and the shortage of the puzzle piece/s 3 can be easily and quickly identified.

Figure 7:
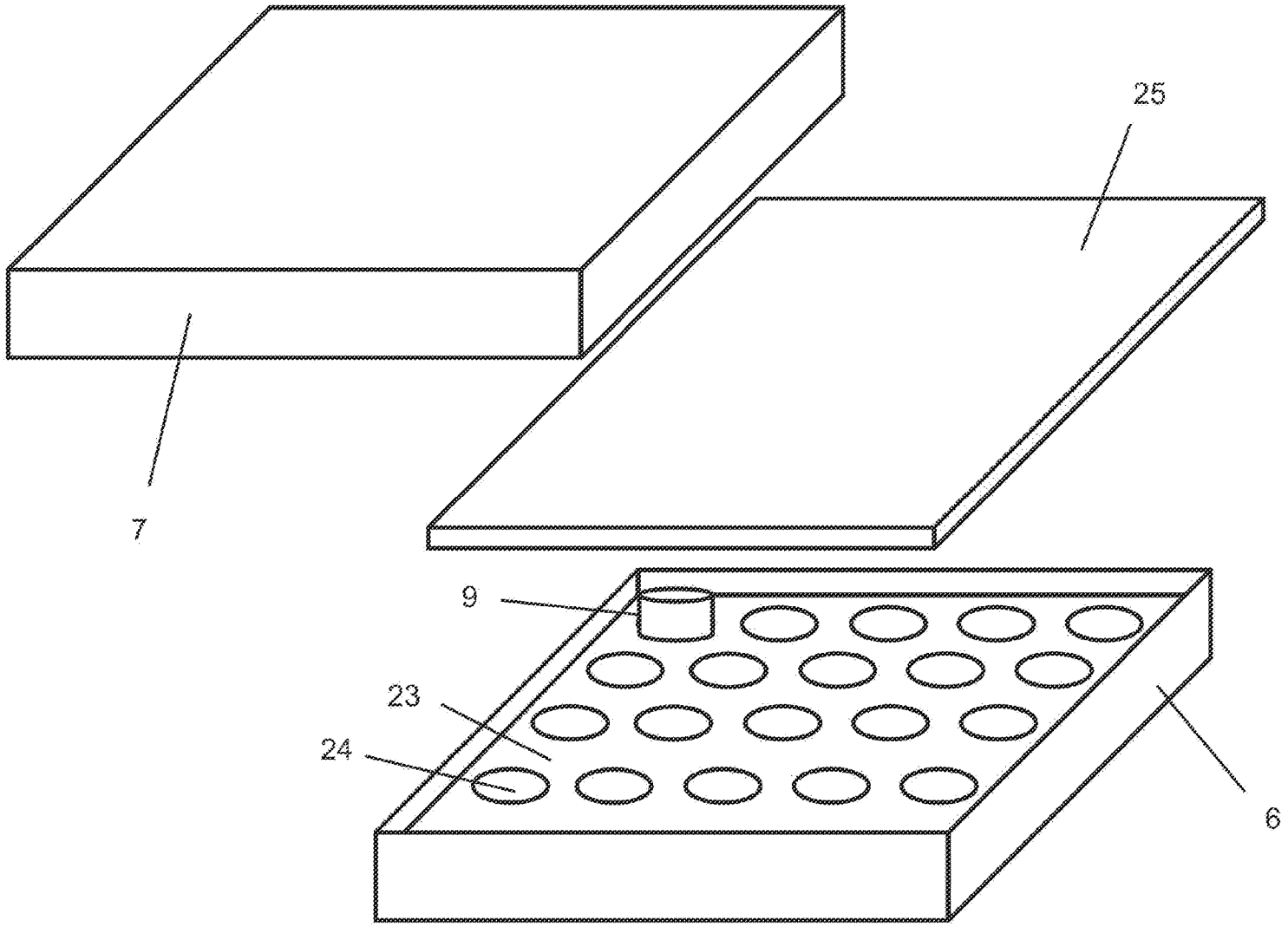

The individual smaller storage containers 9 can be received according to the exemplary embodiments of FIG. 7 into a cube-shaped storage container 6, 7 in the form of a 2-piece box. As shown in FIG. 7, an insert element 23 with a plurality of pockets 24 is arranged in the bottom part 6, wherein the smaller storage containers 9 can be inserted in the pockets 24. Here, the diameter of the pockets 24 can be somewhat smaller than the outer diameter of the smaller storage containers 9, so that a smaller storage container 9 fits tightly in the pocket 24 of the insert element 23.

The smaller storage containers 9 can be unclosed on the top, since an intermediate layer element 25 is inserted between the smaller storage containers 9 and the cover part 7, so that this closes the upper sides of the smaller storage containers 9. Preferably the intermediate layer element 25 can be elastically deformable, so that it can be pressed against the smaller storage containers 9 with the cover part 7, so that the smaller storage containers 9 are closed securely.

In this exemplary embodiment, the user can at will remove and separately empty the individual smaller storage containers 9 after opening the storage container 6, 7 by removing the cover part 7 and removing the intermediate layer element 25. However, the user can at least partly leave the smaller storage containers 9 in the insert element 23 and jointly empty the smaller storage containers 9 kept in the insert element 23 by simply turning over the bottom part 6. Accordingly, the user can himself ascertain the difficulty level of the puzzle 1 by either only assembling individual or multiple partial segments of the puzzle 1 according to the groups in the smaller storage containers 9 or assembling the entire puzzle 1 with all partial segments by tipping together all the puzzle pieces from the smaller storage containers 9. Moreover, the user can identify if the respective smaller storage containers 9 contain the correct number of puzzle pieces 3 at a glance, since the puzzle pieces 3 stacked in the smaller storage container 9 must be arranged flush either with a marking or with a specified limit of the smaller storage container 9.

Figure 8:
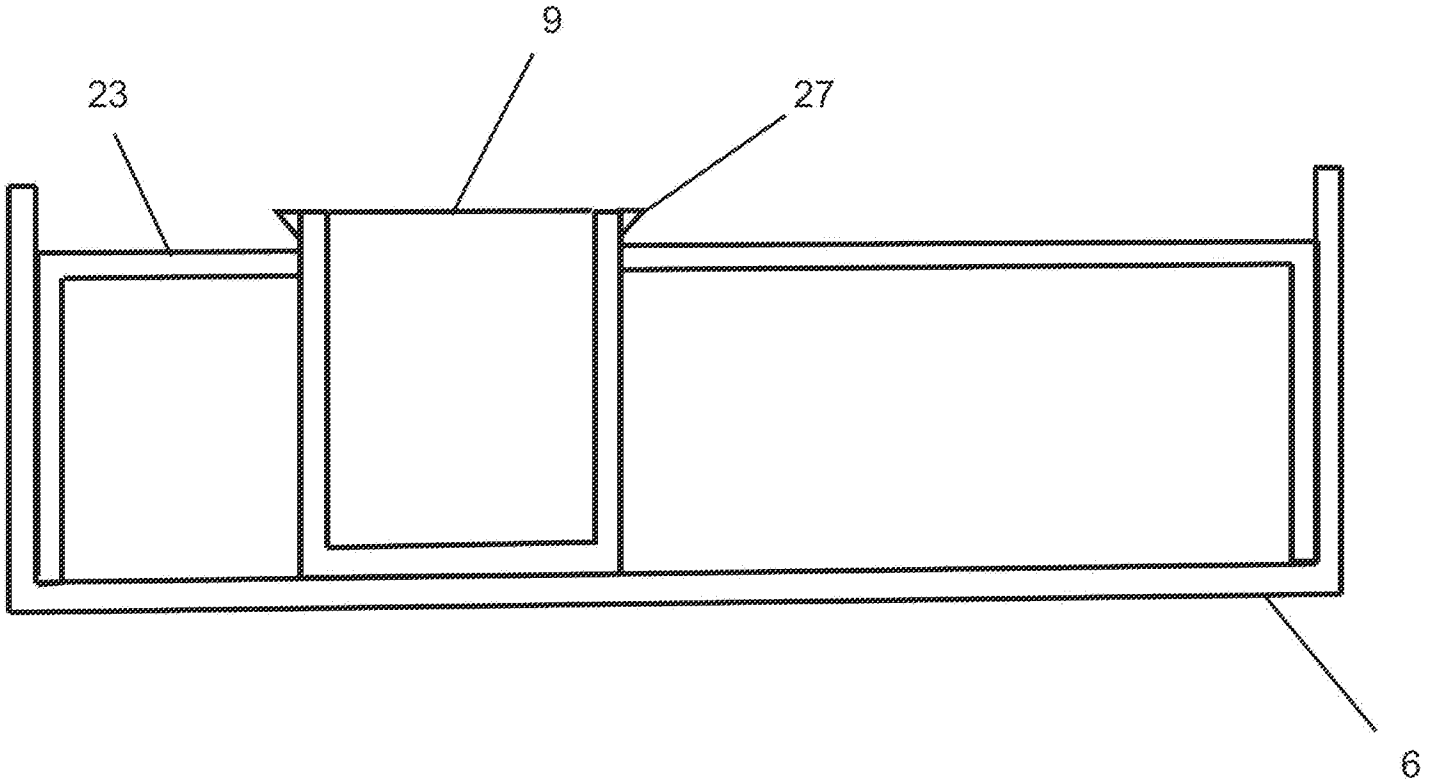

FIG. 8 shows a sectional view through the bottom part 6 of the storage container 6, 7 of the FIG. 7. FIG. 8 shows a smaller storage container 9 which is wedged in the insert element 23. The smaller storage container 9 has a strengthened edge 27 in order to make it easier for the user to easily grip the smaller storage container 9 and remove it from the insert element 23.

Although the present invention is described in detail using the exemplary embodiments, it is evident to the expert that the invention is not limited to these exemplary embodiments. Rather variations are possible in that individual characteristics are left out or other combinations of characteristics can be achieved without leaving the scope of protection of the enclosed claims. The present disclosure especially includes all combinations of the individual characteristics shown in the various exemplary embodiments, so that individual characteristics described only in relation to one exemplary embodiment can also be used in other exemplary embodiments or in combinations of individual characteristics not shown explicitly.

LIST OF REFERENCES

1 Puzzle
2 Picture
3 Puzzle piece
4 Protrusion
5 Recess
6 Bottom part
7 Cover part
8 Insert
9 Smaller storage container
10,11,12,13,14,15 Columns
16,17,18,19,20 Rows
21 Separating wall
22 Cap
23 Insert element
24 Pocket
25 Intermediate layer element
26 Marking
27 Strengthened edge

The invention claimed is:

1. A sales unit comprising:

a puzzle consisting of a plurality of puzzle pieces all of which together form a picture by assembling said puzzle pieces to each other wherein said puzzle pieces have protrusions and recesses wherein at least one protrusion matches a recess, so that the corresponding puzzle pieces can be assembled;

a storage container for the puzzle pieces; and two or more smaller storage containers which are arranged in the storage container for the puzzle pieces;

wherein the puzzle pieces of the picture are assembled into two or more groups with two or more of the puzzle pieces respectively;

wherein the groups of puzzle pieces are arranged in the storage container separately from one another;

wherein each of the smaller storage containers receives a group of the puzzle pieces;

wherein each of the smaller storage containers is designed in such a manner that through the design of the smaller storage containers and the puzzle pieces the completeness of the puzzle pieces of each group of puzzle pieces can be ascertained through the interaction of the puzzle pieces and of the smaller storage containers;

wherein the puzzle pieces are sorted into a group according to at least one characteristic of the puzzle pieces selected from a number of characteristics comprising the relation to one or more rows of the puzzle, the relation to a part of one or more rows of the puzzle, the relation to one or more columns of the puzzle, the relation to a part of one or more columns of the puzzle, the relation to any local area of the puzzle, one or more basic colors or color elements of the puzzle pieces, boundary pieces of the puzzle, number of recesses or protrusions of the puzzle pieces, and combinations thereof; and wherein the smaller storage container is designed in such a manner that the smaller storage container defines a storage space which has the exact dimensions so that a stack of a certain number of puzzle pieces are wedged in the storage space or closes flush with an upper edge of the storage space.

2. The sales unit according to claim 1, wherein the dimensions of the puzzle pieces of a group and the dimensions of the related smaller storage container are matched to one another in such a manner that exactly a certain number of puzzle pieces, corresponding to the number of puzzle pieces of the group, fits into the related smaller storage container, or that the related smaller storage container has a visible marking which shows the number or completeness of the puzzle pieces in the related smaller storage container when the related smaller storage container is filled with the puzzle pieces.

3. The sales unit according to claim 1, wherein the number of puzzle pieces is identical in each group.

4. The sales unit according to claim 1, wherein the number of puzzle pieces per group is lesser than or equal to 50 puzzle pieces or lesser than or equal to 25 or 10 puzzle pieces.

5. The sales unit according to claim 1, wherein the puzzle pieces of each group of the puzzle pieces represent a clearly defined partial segment of a complete puzzle.

6. The sales unit according to claim 5, wherein the partial segment is defined by at least one characteristic of the puzzle pieces selected from a number of characteristics comprising the relation to one or more rows of the puzzle, the relation to a part of one or more rows of the puzzle, the relation to one or more columns of the puzzle, the relation to a part of one or more columns of the puzzle, the relation to any local area of the puzzle, one or more basic colors or color elements of the puzzle pieces, boundary pieces of the puzzle, number of recesses or protrusions of the puzzle pieces, and combinations thereof.

7. A system for storage of a puzzle consisting of a plurality of puzzle pieces all of which together form a picture by assembling the puzzle pieces to each other, the system comprising:

a storage container; and two or more smaller storage containers;

wherein each smaller storage container receives a group of puzzle pieces with two or more puzzle pieces;

wherein each smaller storage container has a measure so that the completeness of the puzzle pieces of each group of puzzle pieces in the smaller storage containers can be ascertained by using the measure when they are arranged in the smaller storage container; and wherein the smaller storage containers are designed in such a manner that exactly one stack of puzzle pieces can be received in a stack in the smaller storage container.

8. The system according to claim 7, wherein the smaller storage container is designed to be dimensionally stable in at least one dimension in such a manner that the dimensionally stable dimension of the smaller storage container forms the measure.

9. The system according to claim 7, wherein the smaller storage containers are at least one of separate individual containers and trays or sections of a common container for several groups.

10. A system for storage of a puzzle consisting of a plurality of puzzle pieces all of which together form a picture by assembling the puzzle pieces to each other, the system comprising:

a storage container; and two or more smaller storage containers;

wherein each smaller storage container receives a group of puzzle pieces with two or more puzzle pieces; and wherein each smaller storage container has a measure so that the completeness of the puzzle pieces of each group of puzzle pieces in the smaller storage containers can be ascertained by using the measure when they are arranged in the smaller storage container; and wherein the smaller storage container is designed as a closable tube or tub and has a circular cross-section whose diameter is selected in such a manner that the puzzle piece with the largest dimension, among the puzzle pieces to be received, can be received with some gap.

11. The system according to claim 7 or 10, wherein the storage container is formed by a two-piece, cube-shaped carton with a cover and a lower part.

12. The system according to claim 7 or 10, wherein the smaller storage containers are formed by a one-piece insert for the storage container with a plurality of pockets for storing groups of puzzle pieces or that the storage container has an insert element with a plurality of pockets for keeping the smaller storage containers.

13. The system according to claim 12, wherein the insert or the insert element are imprinted with the representation or the motif of the puzzle.

14. The system according to claim 7 or 10, wherein the system furthermore comprises an intermediate layer element which is arranged between the storage container, and the smaller storage containers in order to securely hold or to close the smaller storage containers, wherein the intermediate layer element is elastically deformable.

15. A method for manufacturing a puzzle consisting of a plurality of puzzle pieces having protrusions and recesses, all of which together form a picture by assembling said puzzle pieces to each other, the method comprising:

separating a picture into a plurality of puzzle pieces;

assembling the separated puzzle pieces of the picture in two or more groups of puzzle pieces which are separated from one another in the groups; and storing the separated groups of puzzle pieces in a separate smaller storage container of the system for storage of puzzle pieces according to claim 7 or 10.

16. The method according to claim 15, wherein the puzzle pieces of each group of separated puzzle pieces represents a clearly defined partial segment of the entire puzzle, wherein the partial segment is defined by at least one characteristic of the puzzle pieces of a group selected from a number of characteristics comprising the relation to one or more rows of the puzzle, the relation to a part of one or more rows of the puzzle, the relation to one or more columns of the puzzle, the relation to a part of one or more columns of the puzzle, the relation to any local area of the puzzle, one or more basic colors or color elements of the puzzle pieces, boundary pieces of the puzzle, number of recesses or protrusions of the puzzle pieces, and combinations thereof.

17. A sales unit comprising:

a puzzle consisting of a plurality of puzzle pieces all of which together form a picture by assembling said puzzle pieces to each other wherein said puzzle pieces have protrusions and recesses wherein at least one protrusion matches a recess, so that the corresponding puzzle pieces can be assembled;

a storage container for the puzzle pieces; and two or more smaller storage containers which are arranged in the storage container for the puzzle pieces;

wherein the puzzle pieces of the picture are assembled into two or more groups with two or more of the puzzle pieces respectively;

wherein the groups of puzzle pieces are arranged in the storage container separately from one another;

wherein each of the smaller storage containers receives a group of the puzzle pieces;

wherein each of the smaller storage containers is designed in such a manner that through the design of the smaller storage containers and the puzzle pieces the completeness of the puzzle pieces of each group of puzzle pieces can be ascertained through the interaction of the puzzle pieces and of the smaller storage containers; and wherein the puzzle pieces are stacked within the smaller storage containers.

18. The sales unit according to claim 1, wherein the smaller storage container is designed in such a manner that the smaller storage container defines a storage space which has a marking which functions as a measure for the number of puzzle pieces received in the smaller storage container.

19. The system according to claim 7 or 10, wherein the smaller storage container has a marking which functions as the measure.

20. The sales unit according to claim 1, wherein the puzzle pieces of each of the groups with two or more of the puzzle pieces abut each other within a storage compartment of one of the smaller storage containers.

21. The system according to claim 7 or 10, wherein the puzzle pieces of each of the groups with two or more of the puzzle pieces abut each other within a storage compartment of one of the smaller storage containers.

22. The system according to claim 10, wherein the smaller storage container is designed to be dimensionally stable in at least one dimension in such a manner that the dimensionally stable dimension of the smaller storage container forms the measure.

23. The system according to claim 10, wherein the smaller storage containers are at least one of separate individual containers and trays or sections of a common container for several groups.

* * * * *